US008413913B2

(12) United States Patent
Hansen

(10) Patent No.: US 8,413,913 B2
(45) Date of Patent: Apr. 9, 2013

(54) BOUNDARY EDGE FILTER OF A UNIT FUEL INJECTOR

(75) Inventor: Erik Jordan Hansen, Elgin, SC (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 377 days.

(21) Appl. No.: 12/914,017

(22) Filed: Oct. 28, 2010

(65) Prior Publication Data

US 2012/0104115 A1 May 3, 2012

(51) Int. Cl.
*F02M 61/20* (2006.01)

(52) U.S. Cl.
USPC ..... 239/533.9; 239/86; 239/88; 239/96; 239/533.2; 239/575; 239/584; 239/585.1; 239/590; 239/590.3; 239/DIG. 23

(58) Field of Classification Search ..... 239/86, 239/88–96, 533.2, 533.8, 533.9, 575, 584, 239/585.1–585.5, 590–590.5, DIG. 23
See application file for complete search history.

(56) References Cited

U.S. PATENT DOCUMENTS

| | | | | |
|---|---|---|---|---|
| 4,852,803 | A * | 8/1989 | Gaskell | 239/533.9 |
| 5,772,123 | A * | 6/1998 | Augustin et al. | 239/575 |
| 6,648,247 | B2 * | 11/2003 | McFarland | 239/575 |
| 6,845,926 | B2 | 1/2005 | Lei | |
| 7,770,812 | B2 * | 8/2010 | Sebastian | 239/590 |
| 2002/0174854 | A1 | 11/2002 | Lei | |

* cited by examiner

*Primary Examiner* — Steven J Ganey
(74) *Attorney, Agent, or Firm* — Mark C. Bach; Jeffrey P. Calfa

(57) ABSTRACT

A unit fuel injector (30) has a boundary edge filter. A first endless annular internal space (100) is open to a holes (92) forming a fuel inlet port, a second endless annular internal space (102) that is spaced axially of the first endless annular internal space and through which fuel is supplied to an injection mechanism, and a series of circumferentially spaced apart, axially extending channels (104) through which fuel can pass from the first endless annular internal space to the second endless annular internal space.

10 Claims, 2 Drawing Sheets

BOUNDARY EDGE FILTER OF A UNIT FUEL INJECTOR

TECHNICAL FIELD

This disclosure relates to a unit fuel injector for direct high-pressure injection of diesel fuel into an engine cylinder, and in particular to an internal boundary edge filter for filtering particulate matter that may have entered the unit fuel injector.

BACKGROUND OF THE DISCLOSURE

One type of unit fuel injector is commonly known as a HEUI injector, the four-letter acronym standing for hydraulically-actuated, electrically-controlled unit injector.

A HEUI injector has a fuel inlet port communicated to a source of fuel under pressure, such as pressurized fuel in a fuel rail. It also has an oil inlet port communicated to a source of hydraulic fluid under pressure, such as pressurized oil in an oil rail. Fuel is injected out of the injector through orifices in a nozzle having a tip end disposed within the head end of an engine cylinder.

Injection of fuel is controlled by an electric actuator that when actuated opens a valve that allows oil from the oil rail to pass through the oil inlet port and apply hydraulic force to a piston that is disposed at one end of a plunger. The hydraulic force is transmitted through the piston and the plunger to fuel that the fuel pressure in the fuel rail has forced into the fuel injector, increasing pressure on fuel in the injector. The increased pressure is applied both to an inlet check and to a reverse flow check.

When the actuator is not actuated, the inlet check allows fuel to flow from the fuel inlet port through an inlet through-passage to replenish fuel in the injector. When the actuator is actuated to increase pressure on fuel in the injector, the inlet check is forced to close the inlet through-passage, thereby preventing the replenished fuel from back-flowing out of the injector through the fuel inlet port. The increased fuel pressure also forces the reverse flow check to open a high-pressure injection passage to the nozzle so that increased fuel pressure applied along the high-pressure injection passage can unseat a spring-biased needle from a seat in the nozzle and allow the hydraulic force being applied to the piston to displace the piston and the plunger and force fuel through the high-pressure injection passage to the nozzle and out of the nozzle orifices.

When plunger displacement ceases, fuel injection out of the nozzle orifices ceases. A return spring forces the plunger and the piston to retract, and the reverse flow check operates to substantially close the high-pressure injection passage. By substantially closing the high-pressure injection passage, the reverse flow check avoids the creation of a sudden large pressure drop in the high-pressure injection passage that could otherwise occur as the retracting plunger is creating low pressure that opens the inlet check and draws replenishment fuel into the injector.

When the injector has been replenished, the next actuation of the actuator again forces the inlet check closed to prevent backflow of fuel out of the injector through the fuel inlet port, while forcing the reverse flow check to open. The increased fuel pressure along the high-pressure injection passage unseats the needle against the opposing spring bias to open the high-pressure injection passage to the nozzle orifices, allowing fuel to be injected into an engine cylinder as the plunger extends. When the actuator ceases being actuated, the pressure that the plunger is applying to the fuel drops, allowing a bias spring to re-seat the needle and thereby terminate injection.

Fuel that enters a unit fuel injector has typically already been filtered by one or more filtration devices in the fuel system upstream of the unit fuel injector to remove particulate matter that may be present.

SUMMARY OF THE DISCLOSURE

For whatever reason, small particulate matter may on occasion escape filtration by those devices and enter a unit fuel injector.

Because the ability of a unit fuel injector to inject fuel at very high pressures can have favorable implications for quality of combustion and engine performance, component parts that are subject to those pressures are typically machined metal parts fabricated from materials and with geometries that can tolerate the large cyclical stresses that are created in them by numerous repeated high-pressure injections over the life of a unit fuel injector.

The present disclosure relates to structure that is incorporated into such component parts to create an internal boundary edge filter capable of filtering certain size particulates that may not have been filtered by upstream filtration devices.

The boundary edge filter can be incorporated in the profile of an existing unit fuel injector without sacrificing fuel flow volume that keeps a unit fuel injector supplied with a sufficient quantity of fuel for all injection demands.

The boundary edge filter is incorporated in an edge of a rigid component part at a boundary between that part and at least one other part rigid component part that fit together at the boundary.

In a general way, a boundary edge filter comprises a first endless annular internal space that is open through a fuel inlet port of a unit fuel injector to a fuel source, a second endless annular internal space that is spaced axially of the first endless annular internal space, and a series of circumferentially spaced apart, axially extending channels through which fuel can pass from the first endless annular internal space to the second endless annular internal space.

The total cross sectional area for fuel flow through the channels is large enough to meet injection demand throughout the engine's fueling range, while the cross sectional area for fuel flow through an individual channel is small enough to prevent particulate material above a certain size in the first endless annular internal space from passing into the second endless annular internal space.

The foregoing summary, accompanied by further detail of the disclosure, will be presented in the Detailed Description below with reference to the following drawings that are part of this disclosure.

DETAILED DESCRIPTION

Figure 1:
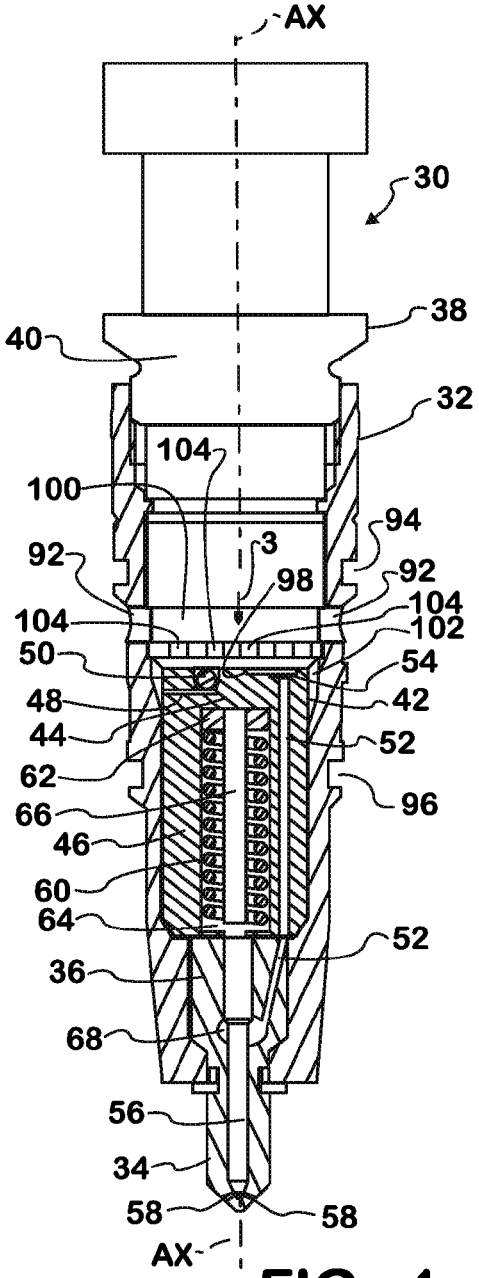
FIG. 1 is an elevation view of a portion of unit fuel injector partly in cross section.

FIG. 1 shows a unit fuel injector 30 comprising a generally cylindrical main body 32 that mounts on a cylinder head of an engine (not shown) to dispose a tip end 34 of a nozzle 36 in the head end of a cylinder bore (not shown) within which an engine piston coupled by a piston rod to a crankshaft reciprocates. Fuel injector 30 is intended for use with a diesel engine to inject diesel fuel directly into the cylinder where the fuel combusts in air that has been compressed by the piston to create pressure that forces the piston to downstroke and impart torque to the crankshaft through the piston rod.

Fuel injector 30 and main body 32 have an imaginary longitudinal axis AX, with main body 32 having an interior that is open at both a proximal end and a distal end. A larger diameter portion of nozzle 36 is disposed within the interior of main body 32 to close the main body's open distal end by abutment of an outer shoulder of nozzle 36 with an inner shoulder of main body 32 while a smaller diameter portion of nozzle 36 that includes tip end 34 protrudes distally out of main body 32.

Figure 2:
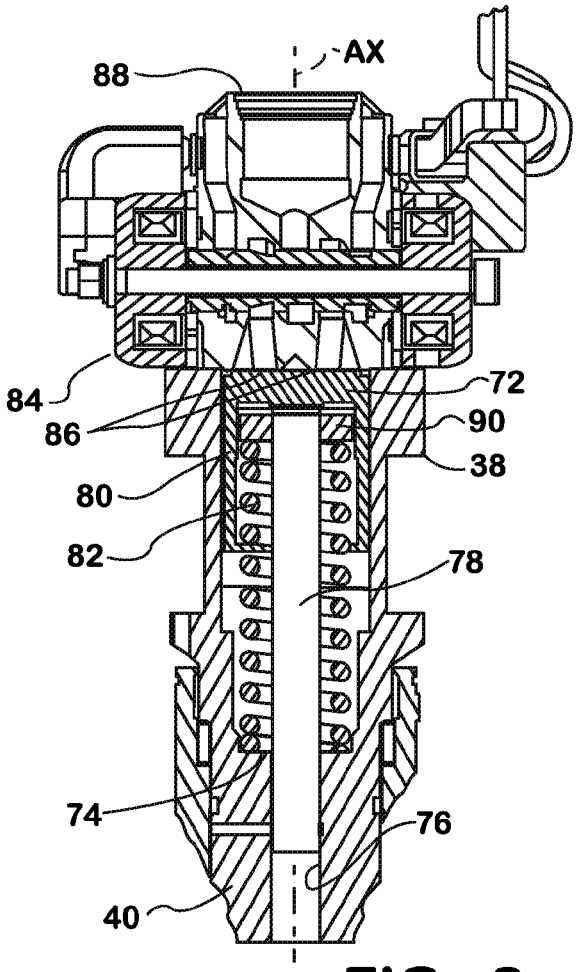
FIG. 2 is a cross section view of a portion of FIG. 1 that is not shown in cross section in FIG. 1.

An intensifier cartridge 38 that comprises a generally cylindrical cartridge body 40 closes the open proximal end of main body 32. FIG. 2 shows a cross section view of intensifier cartridge 38.

The larger diameter portion of nozzle 36 comprises a flat proximal end face against which a distal end face of a spring cage 42 is disposed. Spring cage 42 comprises a proximal end wall 44 having proximal end face disposed against a distal end face of cartridge body 40 and a cylindrical side wall 46 extending distally from end wall 44.

Spring cage 42 comprises a fuel inlet through-passage 48 containing a spherical inlet check 50, and a portion of a high-pressure injection passage 52 containing a reverse flow check 54.

Nozzle 36 contains a needle 56 guided for displacement along axis AX by a needle guide bore that is open at the nozzle's flat proximal end face and that extends distally to tip end 34. Within the interior of tip end 34, the needle guide bore has a tapering surface providing a seat for a tapering end of needle 56. The seat is a proximal boundary for a SAC volume circumferentially around which a series of orifices 58 extend through the nozzle wall to the nozzle exterior.

Spring cage 42 bounds an interior that is open at the distal end. A coiled bias spring 60 is disposed within the spring cage interior for biasing needle 56 to seat on the seat. A proximal end of bias spring 60 bears against an annular shim 62 that in turn bears against end wall 44 while a distal end of spring 60 bears against a disk 64 that in turn bears against a proximal end face of needle 56.

The proximal end of a needle lift pin 66 passes with clearance through the open center of shim 62. Needle lift pin 66 has a length that is less than the axial distance between end wall 44 and the proximal end face of needle 56 when the needle is seated for limiting proximal displacement (i.e. lift) of needle 56 off the seat.

Nozzle 36 comprises a slant passage that forms a continuation of high-pressure injection passage 52 from spring cage 42 to intersect a needle feed cavity 68 that is located between proximal and distal portions of the needle guide bore. Axially between needle feed cavity 68 and the needle seat, radial clearance between needle 56 and the needle guide bore allows fuel flow from needle feed cavity 68 along the needle's length to the needle seat.

As shown in FIG. 2, cartridge body 40 comprises a bore that is coaxial with axis AX and open at both proximal and distal ends. A larger diameter circular bore portion 72 extends distally from the open proximal end to a shoulder 74 from which a smaller diameter circular bore portion 76 extends to the open distal end.

Intensifier cartridge 38 has an injection mechanism that comprises a plunger 78, a piston 80, and a return spring 82 that acts to bias plunger 78 and piston 80 proximally of axis AX.

Mounted at the proximal end of cartridge body 40 is an electric-actuated valve 84 that has an outlet port 86 open to a proximal end face of a circular head of piston 80 and an inlet port 88 that is communicated to oil under pressure in an oil rail (not shown) when fuel injector 30 is installed on an engine.

Piston 80 has a skirt that extends distally from its head and provides a close sliding fit for the piston within larger diameter circular bore portion 72.

Plunger 78 has a smaller diameter than piston 80 and extends distally from the interior of the piston head to have a close sliding fit within smaller diameter circular bore portion 76.

Shoulder 74 provides bearing support for the distal end of return spring 82. The proximal end of return spring 82 bears against a ring 90 on plunger 78 to bias the proximal end of plunger 78 against the piston head without the plunger being attached to the piston head.

At its open distal end, smaller diameter circular bore portion 76 has communication with both fuel inlet through-passage 48 and high-pressure injection passage 52.

Fuel injector 30 is one of several like it that are mounted in an engine cylinder head. Fuel under pressure in a fuel supply system (not shown) serving all fuel injectors can enter main body 32 through one or more holes 92 that form a fuel inlet port of fuel injector 30. Holes 92 are located axially between a proximal circular groove 94 and a distal circular groove 96 that extend around the outside of main body 32 and that contain O-ring seals (not shown) for sealing an exterior zone of main body 32 that is exposed to fuel in the fuel supply system.

With nozzle 36 and spring cage 42 stacked axially within the interior of main body 32, cartridge body 40 is tightly fastened to main body 32 forcing the larger diameter portion of nozzle 36 against main body 32 at the distal end of the latter. The fastening also forces the distal end face of cartridge body 40 against the proximal end face of end wall 44 of spring cage 42 and the distal end of spring cage side wall 46 against the proximal end face of nozzle 36.

At the joint where the distal end face of cartridge body 40 is being forced against the proximal end face of spring cage end wall 44, abutment occurs through one or more sealing ridges that create an enclosed space through which both fuel inlet through-passage 48 and high-pressure injection passage 52 communicate with smaller diameter bore portion 76.

Fuel inlet passage 48 comprises a smaller diameter circular portion joining with a larger diameter circular portion via a tapered portion on which inlet check 50 can seat to close fuel inlet through-passage 48. When unseated, inlet check 50 opens fuel inlet passage 48.

Reverse flow check 54 is disposed in a cavity 98 having an internal ledge that separates a proximal larger diameter portion from a distal smaller diameter portion. Reverse flow check 54 moves within the proximal larger diameter portion of cavity 98 to open and substantially close high-pressure injection passage 52. When substantially closing high-pressure injection passage 52, an area of reverse flow check 54 inward of its outer perimeter margin substantially occludes communication of high-pressure injection passage 52 to smaller diameter bore portion 76. Reverse flow check 54 substantially, rather than totally, closes high-pressure injection passage 52 because of a small central through-hole that restricts flow in order to prevent a sudden large pressure drop in high-pressure injection passage 52 that might otherwise occur when reverse flow check operates from open to substantially closed. When opening high-pressure injection passage 52, reverse flow check 54 seats on the internal ledge of cavity 98, with flow being allowed from smaller diameter bore portion 76 to high-pressure injection passage 52 through open portions (reliefs) in the outer perimeter margin of reverse flow check 54 that extend radially inward of the ledge.

A first annular internal fuel space 100 extends continuously around the outside of cartridge body 40 and the inside of main body 32. Fuel enters fuel injector 30 by passing through holes 92 into fuel space 100.

Figure 3:
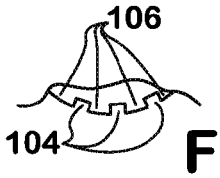
FIG. 3 is a fragmentary view in the direction of arrow 3 in FIG. 1.

A second annular internal fuel space 102 extends continuously around the inside of main body 32 and the outside of cartridge body 40 and spring cage 42 along portions of the latter two parts proximal and distal to where they are in mutual abutment. Fuel space 102 is spaced distally from fuel space 100 but communicates with fuel space 102 through multiple axially extending fuel channels 104 that as shown by FIGS. 1 and 3 are cooperatively defined by the inside of main body 32 and formations 106 in cartridge body 40.

Each fuel channel 104 is bounded circumferentially by a pair of formations 106 which protrude radially outward from cartridge body 40 at its distal end. Each fuel channel 104 has a generally rectangular shape as viewed axially, with three sides being surfaces of cartridge body 40 and the fourth side being the inside surface of main body 32.

Figure 4:
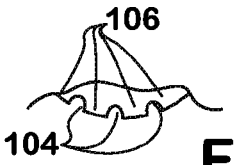
FIG. 4 is a view similar to FIG. 3 showing another embodiment.
Figure 5:
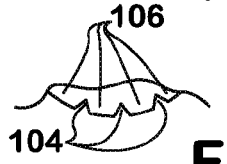
FIG. 5 is a view similar to FIG. 3 showing still another embodiment.

Fuel channels 104 are substantially identical and uniformly spaced from adjacent ones by substantially identical formations 106. It should be understood however that the drawings are only representative and should not be interpreted as suggesting any particular number of fuel channels or any particular size for any fuel channel. For example, fuel channels 104 may have other shapes, examples of which are shown in FIGS. 4 and 5. Not shown are fuel channels that are inclined, i.e. non-parallel to axis AX.

The total cross sectional area for fuel flow through all fuel channels 104 is large enough to meet injection demand throughout the engine's fueling range without creating any significant restriction between fuel space 100 and fuel space 102, while the cross sectional area for fuel flow through an individual fuel channel 104 is small enough to prevent particulate material above a certain size in fuel space 100 from passing into fuel space 102.

With structural detail of fuel injector 30 having been described, its operation will now be explained.

With valve 84 closed and fuel injector 30 having been fully charged with relatively lower pressure fuel from the relatively lower pressure fuel supply system, plunger 78 and piston 80 assume a maximally retracted, initial position as shown in FIG. 2. Fuel that has entered through holes 92 in main body 32 fills fuel space 100, fuel channels 104, fuel space 102, fuel inlet through-passage 48, and smaller diameter bore portion 76 distal to plunger 78. Reverse flow check 54 may or may not be open.

When valve 84 is actuated open, oil passes through to apply hydraulic force to piston 80, initiating distal movement of both piston 80 and plunger 78 to begin forcing fuel out of smaller diameter bore portion 76 and operating inlet check 50 and reverse flow check 54. Because needle 56 is seated closed on its seat in nozzle 36, the fuel being forced out of bore portion 76 flows toward inlet through-passage 48, forcing inlet check 50 to close inlet through-passage 48 so that fuel does not backflow out of fuel injector 30.

With fuel now being essentially trapped in the injector, the hydraulic force of the oil, amplified by the ratio of the larger area of the proximal end face of piston 80 to the smaller area of the distal end face of plunger 78, greatly increases the pressure on the trapped fuel.

If reverse flow check 54 is not already open, the increased fuel pressure opens it so that the increased fuel pressure is felt along high-pressure injection passage 52. Because of the needle geometry, the pressure acts on needle 56 with a proximally directed force component that overcomes the distally directed force of bias spring 60, resulting in unseating of needle 56 and accompanying proximal displacement of disk 64. Continued displacement of plunger 78 forces fuel out of smaller diameter bore portion 76 through high-pressure injection passage 52 and out of nozzle 36 through orifices 58. Shim 62 sets the bias force that spring 60 exerts on needle 56 and hence fuel pressure acting on the needle that must be exceeded in order for the needle to unseat.

Injection continues as long as plunger 78 continues to move distally. When valve 84 closes during an on-going injection, further distal movement of plunger 78 and piston 80 ceases. Fuel pressure along high-pressure injection passage 52 quickly drops, allowing return spring 82 to return plunger 78 and piston 80 proximally toward initial position.

The fuel pressure drop creates a pressure differential that forces reverse flow check 54 to substantially close so that some elevated pressure in high-pressure injection path 52 is maintained as needle 56 re-seats in order to oppose entry of products of combustion in the engine cylinder through nozzle orifices 58 before needle 56 has re-seated. The sudden pressure drop also allows the fuel supply pressure to unseat inlet check 50 so that fuel from the fuel supply system can replenish fuel injector 30 by flowing through holes 92 in main body 32, fuel space 100, fuel channels 104, fuel space 102, fuel inlet through-passage 48, and smaller diameter bore portion 76 distal to plunger 78 as plunger 78 and piston 80 are retracting. Fuel channels 104 are effective in preventing particulate material larger than a certain size in fuel space 100 from passing into fuel space 102 without creating any significant restriction between fuel space 100 and fuel space 102 throughout the engine's fueling range.

Other embodiments of boundary edge filter are shown in remaining FIGS. 6-11.

Figure 6:
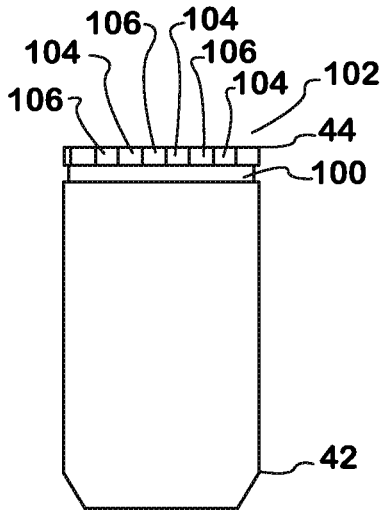
FIG. 6 is an elevation view of one part of still another embodiment.

FIG. 6 shows fuel channels 104 and formations 106 extending around the outside of spring cage proximal end wall 44. Fuel space 100 extends continuously around the outside of spring cage 42 distal to the boundary edge filter cooperatively formed by spring cage 42 and the inside of main body 32. Fuel space 102 is proximal to fuel channels 104 and formations 106, and holes 92 are re-located from FIG. 1 to open to fuel space 100.

Figure 7:
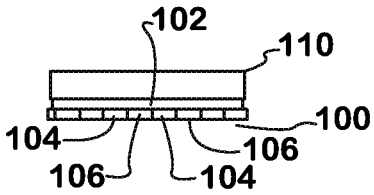
FIG. 7 is an elevation view of still another embodiment.

FIG. 7 shows fuel channels 104 and formations 106 extending around the outside of a check valve body 110 that would contain inlet check 50 and reverse flow check 54 in an embodiment where spring cage 42 lacks a proximal end wall 44 and check valve body 110 is a separate part that closes the open proximal end of spring cage 44. Fuel space 102 extends continuously around the outside of check valve body 110 proximal to the boundary edge filter cooperatively formed by check valve body 110 and the inside of main body 32. Holes 92 are re-located from FIG. 1 to open to fuel space 100. The entrance of fuel inlet through-passage 48 in check valve body 110 is open to fuel space 102.

Figure 8:
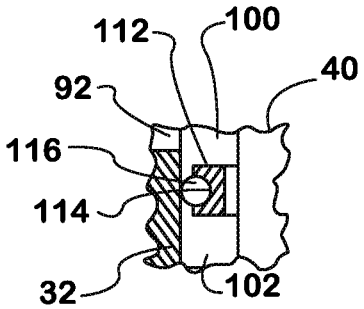
FIG. 8 is a fragmentary cross section view of still another embodiment.
Figure 9:
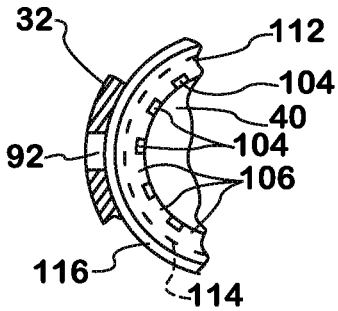
FIG. 9 is a view in the direction of arrow 9 in FIG. 8.

FIGS. 8 and 9 show an embodiment of boundary edge filter that comprises a circular ring 112 having a continuous groove 114 in a radially outer face, and an O-ring seal 116 seated in groove 114. Ring 112 is fit to the outside of cartridge body 40 to create fuel spaces 100, 102 between the cartridge body and the inside of main body 32.

Holes 92 are open to fuel space 100, and fuel inlet through-passage 48 is open to fuel space 102. O-ring seal 116 seals ring 112 to the inside of main body 32.

Fuel channels 104 are cooperatively defined by formations 106 in ring 112 that protrude radially inwardly. Each fuel channel 104 has a generally rectangular shape as viewed axially, with three sides being surfaces of ring 112 and the fourth side being the outside surface of cartridge body 40.

Figure 10:
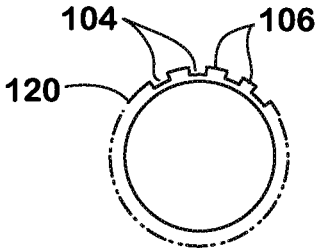
FIG. 10 is a plan view of still another embodiment.
Figure 11:
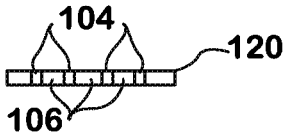
FIG. 11 is an elevation view of FIG. 10.

FIGS. 10 and 11 show an embodiment of boundary edge filter that comprises a circular ring 120 having formations 106 and fuel channels 104 in its outer face. Ring 120 is intended to be pressed onto the outside of cartridge body 40 rather manufacturing cartridge body 40 with the formations.

What is claimed is:

1. A unit injector for injecting liquid fuel directly into an engine cylinder, the unit injector comprising:

a main body circumferentially surrounding an imaginary longitudinal axis;

a fuel inlet port in the main body through which fuel can enter the fuel injector;

an injection mechanism;

a nozzle comprising orifices through which the injection mechanism can inject fuel out of the unit injector; and a boundary edge filter comprising a first endless annular internal space that is open to the fuel inlet port, a second endless annular internal space that is spaced axially of the first endless annular internal space and through which fuel is supplied to the injection mechanism, and a series of circumferentially spaced apart, axially extending channels through which fuel can pass from the first endless annular internal space to the second endless annular internal space;

the total cross sectional area for fuel flow through the channels being large enough to meet injection demand throughout an engine's fueling range, while the cross sectional area for fuel flow through an individual channel is small enough to prevent particulate material above a certain size in the first endless annular internal space from passing into the second endless annular internal space.

2. A unit injector as set forth in claim 1 in which the channels are defined in part by formations which extend radially outwardly in a part that is disposed internally of the main body.

3. A unit injector as set forth in claim 2 in which the part that is disposed internally of the main body comprises a spring cage that houses a bias spring for biasing a needle to close orifices through which fuel is injected out of a nozzle by the injection mechanism.

4. A unit injector as set forth in claim 2 in which the part that is disposed internally of the main body comprises a check valve body having a fuel inlet through-passage extending from the second endless annular fuel space to the injection mechanism and an inlet check disposed in the fuel inlet through-passage.

5. A unit injector as set forth in claim 2 in which the injection mechanism comprises an intensifier cartridge having a cartridge body and the part that is disposed internally of the main body is the cartridge body.

6. A unit injector as set forth in claim 2 in which the injection mechanism comprises an intensifier cartridge having a cartridge body and the part that is disposed internally of the main body comprises a ring fitted around an outside of the cartridge body.

7. A unit injector as set forth in claim 2 in which the channels are defined in part by an inside of the main body.

8. A unit injector as set forth in claim 2 in which the channels are defined in part by formations which extend radially inwardly in a first part that is disposed internally of the main body and fitted to an outside of a second part that is disposed internally of the main body so that the channels are defined in part by the second part.

9. A unit injector as set forth in claim 8 in which the first part has a groove in an outer face and the unit injector further comprises an O-ring seal seated in the groove and sealing to an inside of the main body.

10. A unit injector as set forth in claim 1 in which the channels are parallel with the longitudinal axis.

* * * * *